US009472073B2

(12) United States Patent
Yang

(10) Patent No.: US 9,472,073 B2
(45) Date of Patent: Oct. 18, 2016

(54) EAS TAG FOR BOTTLES

(71) Applicant: Xiao Hui Yang, Saratoga, CA (US)

(72) Inventor: Xiao Hui Yang, Saratoga, CA (US)

(73) Assignee: WG Security Products, Inc., Campbell, CA (US)

( * ) Notice: Subject to any disclaimer, the term of this patent is extended or adjusted under 35 U.S.C. 154(b) by 0 days.

(21) Appl. No.: 14/550,812

(22) Filed: Nov. 21, 2014

(65) Prior Publication Data

US 2015/0137977 A1 May 21, 2015

Related U.S. Application Data

(60) Provisional application No. 61/907,063, filed on Nov. 21, 2013.

(51) Int. Cl.
*G08B 13/14* (2006.01)
*G08B 13/24* (2006.01)
*E05B 73/00* (2006.01)

(52) U.S. Cl.
CPC ..... *G08B 13/2434* (2013.01); *E05B 73/0041* (2013.01); *G08B 13/2448* (2013.01)

(58) Field of Classification Search
CPC ..... G08B 13/2434; G08B 13/2448; G08B 13/248; E05B 73/0041
USPC ..... 340/568.1, 571, 384.1, 572.1–572.9, 340/540, 542, 545.6; 215/201
See application file for complete search history.

(56) References Cited

U.S. PATENT DOCUMENTS 2,093,688 A 9/1937 Smith
6,822,567 B2 * 11/2004 Durbin ..... E05B 73/0041 215/201
7,134,302 B2 11/2006 Gorst
7,259,674 B2 8/2007 Marsilio et al.
7,266,979 B2 9/2007 Belden, Jr.
7,397,375 B2 7/2008 Marsilio et al.
7,486,190 B2 2/2009 Marsilio et al.
7,492,263 B2 2/2009 Marsilio et al.
7,492,264 B2 2/2009 Marsilio et al.
7,492,265 B2 2/2009 Marsilio et al.
7,498,944 B2 3/2009 Marsilio et al.
7,498,945 B2 3/2009 Marsilio et al.
7,570,161 B2 8/2009 Necchi
7,602,297 B2 10/2009 Marsilio et al.
7,866,497 B2 1/2011 Belden, Jr.
8,152,009 B2 4/2012 Hulin
8,269,631 B2 * 9/2012 Yang ..... G08B 13/1463 340/426.1
8,368,537 B2 2/2013 Zhang et al.
8,421,633 B2 4/2013 Yang
8,482,414 B2 7/2013 Leyden et al.

(Continued)

*Primary Examiner* — Anh V La

(74) *Attorney, Agent, or Firm* — Brian W. Foxworthy; Robert R. Waters; Waters Law Group, PLLC

(57) ABSTRACT

An anti-theft device monitors bottles. It is comprised of a two components hingably connected together. They can move from an open position to a closed position to enclose the neck of a bottle. One component has a first latch element and contains electronics including switches. The other component has a second latch element. The latch elements combine to hold the two components in the closed position. When the two components are moved to the closed position, and a bottle is in position, the bottle contacts elements which in turn change the states of associated switches. One of these elements also functions to retain the bottle on the tag. The anti-theft device may be armed or disarmed by remote devices. The latching elements may be releasably lockable such as by a magnet. The anti-theft device may have passcode protection capabilities.

20 Claims, 8 Drawing Sheets

(56) References Cited

U.S. PATENT DOCUMENTS

| | | | | |
|---|---|---|---|---|
| 8,665,095 | B2 | 3/2014 | Yang | |
| 2005/0237205 | A1 | 10/2005 | Gorst | |
| 2010/0253524 | A1* | 10/2010 | Kolton | B65D 23/14 340/572.9 |
| 2011/0140894 | A1* | 6/2011 | Sayegh | G08B 13/2434 340/572.8 |
| 2012/0151974 | A1 | 6/2012 | Zhang et al. | |
| 2012/0152883 | A1 | 6/2012 | Zhang et al. | |
| 2013/0321153 | A1* | 12/2013 | Yang | G08B 13/2434 340/572.1 |

* cited by examiner

EAS TAG FOR BOTTLES

CROSS REFERENCE TO RELATED APPLICATIONS

This application claims priority to U.S. Provisional Application 61/907,063 filed on Nov. 21, 2013. The entirety of U.S. Provisional Application 61/907,063 including both the figures and specification are incorporated herein by reference.

FIELD OF INVENTION

The present application is generally related to an anti-theft tag, and more specifically, an anti-theft tag that attaches to wine bottles or other similar bottles. Also, the tag of the present application may be used with various electronic article surveillance (EAS) systems, including for example, an EAS system utilizing tags and deactivators featuring wireless communication for deactivation and alarming, such as RFID systems, and featuring dynamic time based passcode modification and other tamper resistant features, and/or an EAS system using passive element technology. In certain applications the mere presence of the tag may be deemed to be sufficient deterrence from theft and in those applications the anti-theft tag may actually not have any EAS electronics.

BACKGROUND OF THE INVENTION

Theft is a major concern for retail operations. While electronic article surveillance (EAS) systems are in wide use, it is still necessary to adapt the individual monitoring elements, or tags, to specific variations of protected products, including bottled products. Wine, for example, is a bottled product that can easily be valuable enough to justify the use of EAS technology to prevent theft. Embodiments of the present invention are capable of attaching to wine bottles and other bottles of similar shape and configuration.

SUMMARY OF EMBODIMENTS OF THE INVENTION

The present invention is for an antitheft electronic article surveillance tag having a first and second component hingably attached to each other. The two hinged components can move from the many open positions of an open state to the closed position of a closed state. When in the closed position the two components combine to form a passageway which can close around the neck of a wine bottle, or similar bottle. The first component has a housing and a first latching component. The second component has a second latching component. When the first and second components are in the closed position, and the first and second latching components are engaged, the latching components keep the first and second components in the closed position. The latching components are releasable so that the anti-theft tag may be removed from an object by an authorized person. The housing may also contain a blocking component to lock the latching components in position to prevent them from being disengaged without authorization. This blocking component is releasable as well.

In some embodiments, the second component will have a hoop at one end. In those embodiments, the top of a bottle is inserted through the hoop before the first and second components are rotated to the closed position and latched in the closed position. This hoop provides an additional resistance to forced removal of the second component from the first component. If an attempt is made to pry the second component from the first component, the hoop will press against the bottle and make this more difficult. Additionally, as will be described later, the first component has switches which have their state changed by a bottle when the tag is installed on a bottle. If the second component is forced away from the first component, the hoop will pull the bottle along with it, moving the bottle away from the switches, allowing the state of the switches to change. In some embodiments of the tag, the second component will be closed at the end opposite the hoop.

The housing contains an internal compartment which holds several electronic components. Among the electronics components are arming switches. One arming switch is associated with a spring biased yoke that extends from the housing of the first component into the passageway. As the two components are rotated to the closed position about a bottle, the bottle depresses the yoke into the housing and changes the state of its associated switch. Another arming switch is associated with a spring biased lever that extends from the housing into the passageway, as the two components are rotated to the closed position about a bottle, the bottle moves the lever about its pivot and the lever changes the state of its associated switch. Another switch is associated with the first latching component of the first component. When the first latching component is moved to the latched position, the associated switch has its state changed. When either or both of the yoke and lever are depressed by a bottle and the first latching component is moved to the latched position, the tag is armed. If the state of the switches associated with the yoke and, or, lever change without the electronics of the tag being disarmed by an external device or by the latch being properly disengaged, the tag will alarm.

Among the other electronics which may be contained in the electronics compartment of the housing of the anti-theft tag are: a microprocessor, a circuit board, a battery, a passive EAS element, an audible alarm producing device, light emitting diodes, and communication elements including wireless communication elements such as radio frequency (RFID), optical (infrared), or other communication elements. The microprocessor or circuit board can detect when the switches undergo a changes in state. If an appropriate combination of switch states occurs, the tag may be armed. In some embodiments, the order in which the switches change state will also determine whether a tag arms. For example, it may be required that at least one of the switches associated with the yoke and lever change state before the latch switch. This would indicate that a bottle has been enclosed before the latch was engaged.

In some embodiments, the latch switch detects when the latch has been engaged and that, in combination with at least one other switch, is sufficient to arm the electronics. In other embodiments, the EAS tag may be armed using an external device that communicates with the tag via the communication elements which may be wireless optical communication elements (such as infrared), wireless radio frequency communication elements (such as RFID), or other communication elements. The external device can be a hand held remote communication device or a device associated with a base station.

Once armed, if the electronics detect an unauthorized change in status, the electronics can determine an alarm condition and issue an alarm. For example, if a tag is removed from a protected bottle, and the bottle neck is removed from the passageway, the status of the one of the switches associated with the yoke or lever will change. If an authorization signal is not previously received by the tag, the electronics will determine an alarm condition and issue an alarm. This alarm may be an audible alarm or an alarm broadcast to a respective receiver in an electronic article surveillance anti-theft system. The broadcast may be by infrared communications, radio frequency communications (RFID), or other wireless type communications.

Disarming of the EAS tag may be accomplished by authorized personnel. An authorized person having access to other elements of the EAS system such as a hand held communication device or a base station having communication capabilities may disarm the device. Some embodiments will add another element of security with passcode capabilities in the respective electronics. The EAS tag electronics of these embodiments are capable of storing a passcode which is known to the communication elements of the EAS system and which can be used to confirm to the EAS tag that the disarming signal is authorized. A further element of security can be added by using clock based algorithms to change the passcode synchronously. In those embodiments, the EAS system and the EAS tag both have clock generators and are programmed with the same algorithm and both are programmed with the same initial passcode. As time passes, the algorithm alters the passcode at preset intervals as regulated by the clock generators. This changing passcode further complicates unauthorized attempts to disarm the EAS tag. If an EAS tag is detached without being disarmed with the appropriate passcode, the EAS tag will detect an alarm condition and generate an alarm.

To physically prevent the release of the engaging of the first latching and the second latching component and the movement of the first component and the second component from the closed position, a blocking component or mechanism may be employed. In one embodiment, a biased blocking member moves into a blocking position when the first and second latching components engage. The biased blocking member has a magnetically attractable element associated with it, and when a magnet is applied to the EAS tag, the biased blocking member moves to a position where it no longer blocks the release of the latching components. If a magnet is used to detach an EAS tag without authorization and the EAS tag is still armed, the electronics detect an alarm condition and generate an alarm. In some embodiments a magnet may be built into a communication device so that the EAS tag may be disarmed and its latch released for detachment using the same device.

BRIEF DESCRIPTION OF DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS OF THE INVENTION

Figure 1:
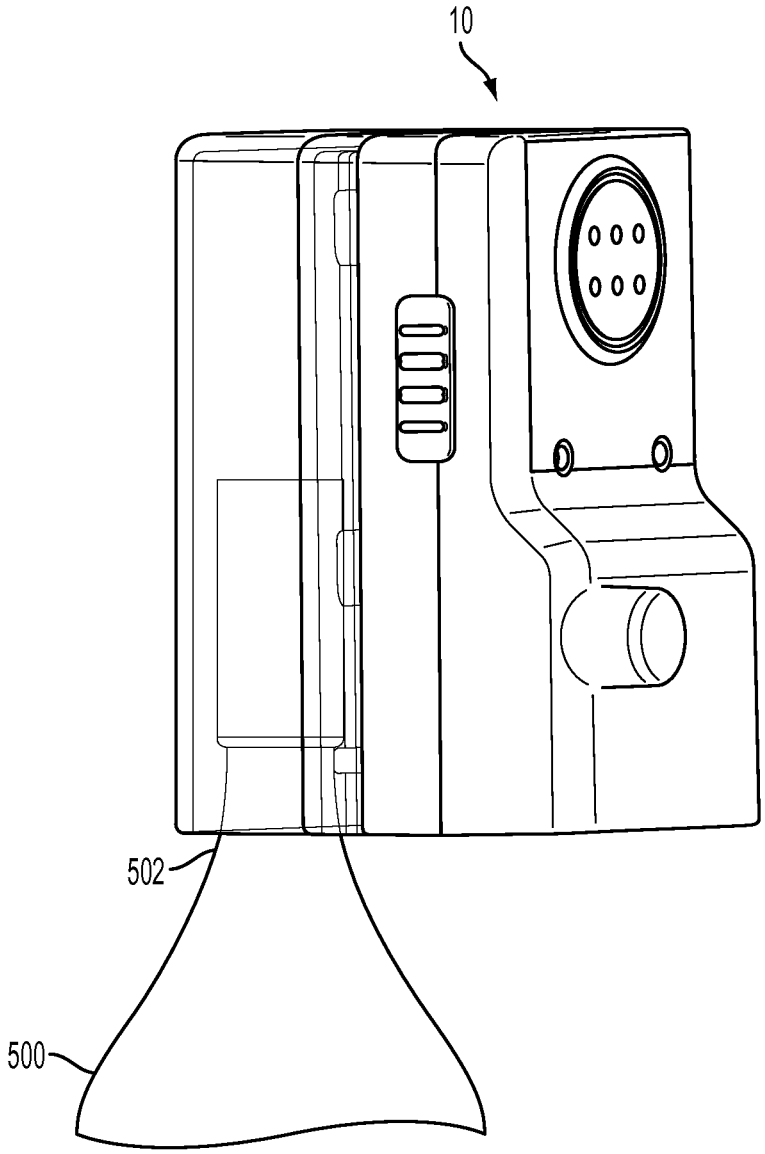
FIG. 1 is an oblique view of an embodiment of an anti-theft tag of the present invention closed around the neck of a bottle to be protected.

FIG. 1 is an oblique view of an embodiment of anti-theft tag 10 of the present invention closed around the neck of a bottle 500 to be protected. Bottle 500 may be a wine bottle or other bottle having a bottle neck 502 and an annular feature around its neck 502. Tag 10 in FIG. 1 is comprised of a first component 20 and a second component 30 hinged together. First component 20 and second component 30 can move between a myriad of open positions and a closed position. When in the closed position, tag 10 forms a cavity or passageway for fitting around neck 502 of bottle 500. In the embodiment of FIG. 1, second component 30 is made of transparent material and part of bottle 500 is visible through second component 30.

Neck 502 is of a size that anti-theft tag 10 can accommodate. The annular feature may take several forms. The annular feature may be: an increase in diameter of neck 502 which starts proximal to the end of bottle 500 and continues to the end; an increase in diameter of neck 502 which starts proximal to the end of bottle 500 and returns to the nominal diameter of neck 502 before the end, i.e. a raised ring; or, a recessed ring proximal to the end of neck 502 of bottle 500. In FIG. 1, the annular feature 504 is a raised ring around neck 502 of bottle 500.

Figure 2:
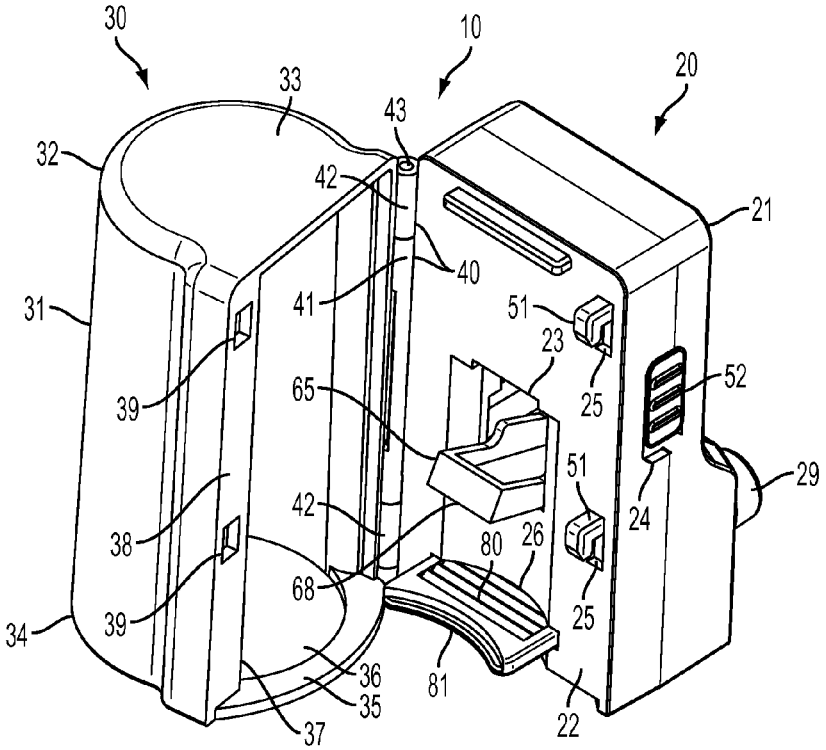
FIG. 2 is a top perspective view of the embodiment an anti-theft tag of FIG. 1 in an open position.
Figure 3:
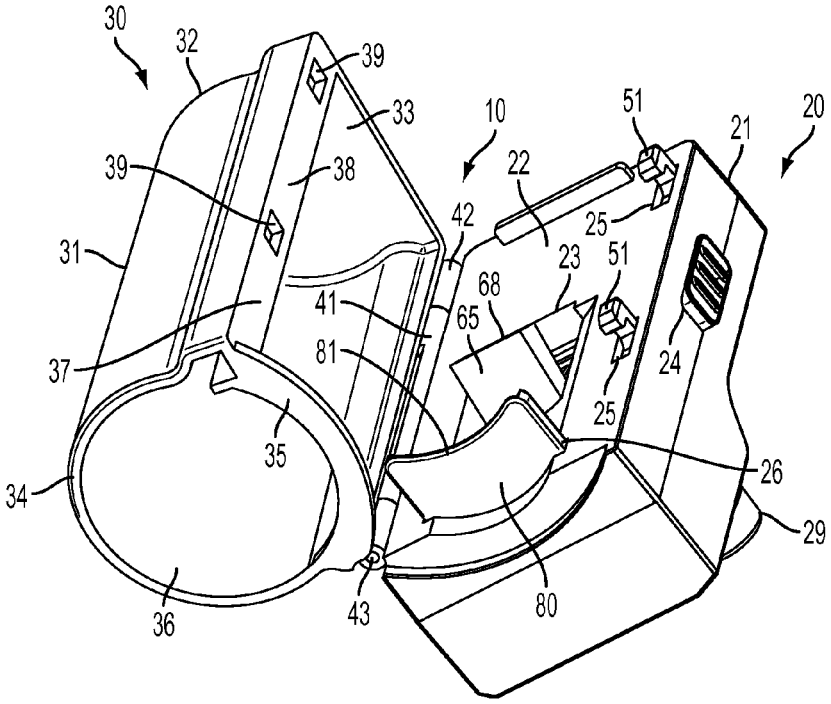
FIG. 3 is bottom perspective view of the embodiment of the anti-theft tag of FIG. 1 in an open position.

FIG. 2 is a top perspective view of the embodiment of anti-theft tag 10 shown in FIG. 1, and FIG. 3 is a bottom perspective view of the embodiment of anti-theft tag 10 of FIG. 1, both in the open position. Many features of tag 10 are visible in both FIGS. 2 and 3. In the embodiment of tag 10 shown in FIGS. 2 and 3, first component 20 generally forms a housing 21 for enclosing mechanical and electronic features of tag 10, while second component 30 generally forms a cover 31 complimentary to first component 20 for enclosing the neck 502 of a bottle 500. To that end, second component 30 is mostly a cylindrical shell 31 having a section cut off along a plane parallel to its axis and having one closed end 32 and one open end 34. End panel 33 closes closed end 32 of second component 30. Hoop 35 at open end 34 of second component 30 creates a full circular bottle aperture 36 and passes all the way around any bottle inserted into second component 30. The section cut from cylindrical shell 31 forms a rectangular aperture 37 which closes against first component 20 and exposes an enclosed bottle neck to elements of first component 20.

Hinge 40 connects first component 20 and second component 30. Hinge 40 is formed of first hinge component 41, second hinge components 42, and hinge pin 43. First hinge component 41 is actually part of first component 20 and second hinge components 42 are actually parts of second component 30. Hinge pin 43 passes through both first hinge component 41 and second hinge components 42 to hold the two parts together and allow the hinging motion.

In addition to cylindrical shell 31, second component 30 has latch receiver panel 38 along the edge of rectangular aperture 37 opposite to second hinge components 42. Latch receiver panel 38 has latch receiver apertures 39 which receive hooks 51 of latch 50 when first component 20 and second component 30 are in the closed position. Latch button 52 is used to move latch 50 back and forth. Hooks 51 engage the edges of latch receiver panel 38 around latch receiver apertures 39 when first component 20 and second component 30 are in the close position and latch 50 us moved to the latched position. Hooks 51 extend out of hook apertures 25 of first component 20 and latch button 52 is accessible through latch button aperture 24.

Closing surface 22 on first component 20 faces second component 30 and closes over rectangular aperture 37 in second component 30 when first component 20 and second component 30 are in the closed position. Lever 65 extends from lever aperture 23 in closing surface 22 of first component 20 and yoke 80 extends from yoke aperture 26 in closing surface 22 of first component 20. Lever 65 and yoke 80 are moved when a bottle is place in second component 30 and first component 20 and second component 30 are rotated to the closed position. As will be discussed below, depending on the embodiment of tag 10, lever 65 or yoke 80 or both may have an arming switch in the electronics package of first component 20 associated with them. When a switch is associated with them, lever 65 and yoke 80 changed the state of the switch when a bottle is enclosed by tag 10.

Figure 6:
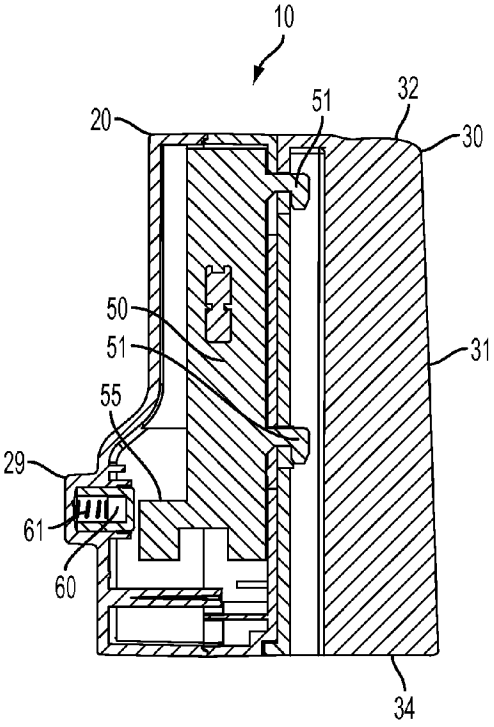
FIG. 6 is a section view of the embodiment of the anti-theft tag of FIG. 1 in the plane shown in FIG. 4.
Figure 5:
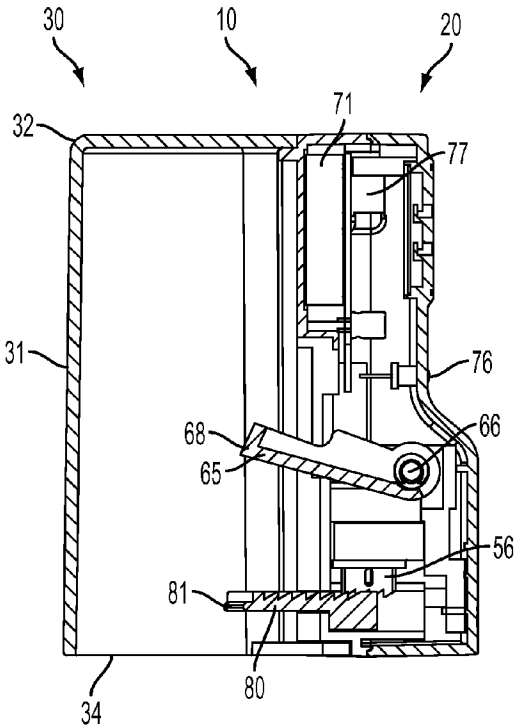
FIG. 5 is a section view of the embodiment of the anti-theft tag of FIG. 1 in the plane shown in FIG. 4.
Figure 4:
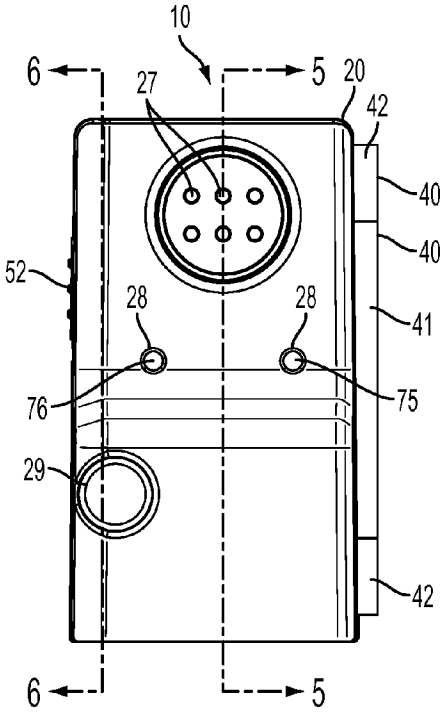
FIG. 4 is a back view of the embodiment of the anti-theft tag of FIG. 1 showing section planes for FIGS. 5 and 6.

FIG. 4 is a back view of the embodiment of anti-theft tag 10 of FIG. 1 showing section planes for FIGS. 5 and 6. Several features in housing 21 that accommodate elements internal to housing 21 are visible in FIG. 4. Sound apertures 27 in housing 21 allow sounds generated inside housing 21 easier exit from housing 21. Optical apertures 28 give exposure to an LED and an optical communication port. Dome 29 houses a blocking mechanism which keeps latch 50 in the latched position when latch 50 is shifted to that position.

FIG. 5 is a section view of the embodiment of the anti-theft tag 10 of FIG. 1 in the plane shown in FIG. 4. FIG. 6 is a section view of the embodiment of anti-theft tag 10 of FIG. 1 in the plane shown in FIG. 4. In FIG. 5, arming lever 65 is pivotally mounted within housing 21 and extends out through lever aperture 23 to be exposed and contacted by the neck of a bottle enclosed by tag 10. Similarly, yoke 80 is mounted within guides in housing 21 and extends out through yoke aperture 24 to be exposed and contacted by the neck of a bottle enclosed by tag 10.

Figure 7:
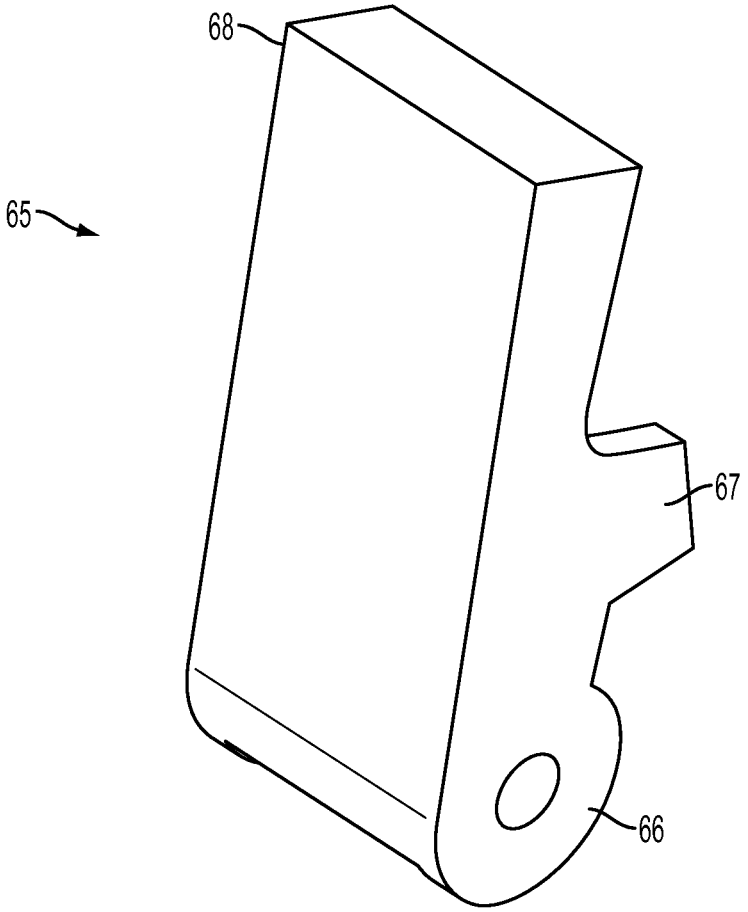
FIG. 7 is a perspective view of an arming lever of the embodiment of the anti-theft tag of FIG. 1.

FIG. 7 is a perspective view of lever 65 of the embodiment of anti-theft tag 10 of FIG. 1. Lever 65 is also shown in FIGS. 2, 3, and 5. Lever 65 has pivot aperture 66, switch tab 67, and contact edge 68. Lever 65 is mounted in housing 21 of first component 20 by pivot aperture 66 and a spring biases it outward from housing 21 so that contact edge 68 is contacted by a bottle enclosed by tag 10. When contact edge 68 is contacted by a bottle, lever 65 is partially rotated back into housing 21 and switch tab 67 contacts a switch and changes the state of the switch.

Figure 8:
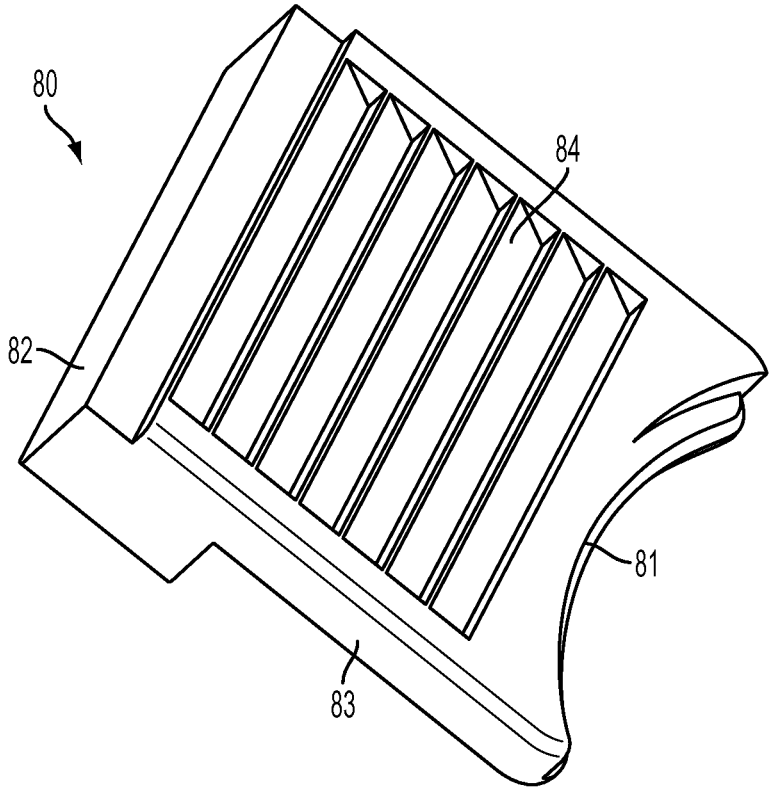
FIG. 8 is a perspective view of a sliding yoke of the embodiment of the anti-theft tag of FIG. 1.

FIG. 8 is a perspective view of sliding yoke 80 of the embodiment of anti-theft tag 10 of FIG. 1. Sliding yoke 80 is also shown in FIGS. 2, 3, and 5. Sliding yoke 80 has contact surface 81 opposite base 82, sides 83 running between contact surface 81 and base 82, and linear ratchet 84 on its top surface. Sides 83 are straight and fit in guides within housing 21 of first component 20. Springs within housing 21 bear, directly or indirectly, on base 82 of sliding yoke 80 to bias sliding yoke 80 to extend out of yoke aperture 26 in housing 21 of first component 20. When a bottle is enclosed by tag 10, the bottle contacts contact surface 81 on sliding yoke 80 and moves yoke 80 at least partially back into housing 21. When yoke 80 is moved back into housing 21, yoke 80 contacts a switch and changes its state. As will be discussed below, when tag 10 is installed on a bottle and latched close by moving latch 50, pawl 56 carried on latch 50 engages ratchet 84 on sliding yoke 80 and keeps yoke 80 from moving, maintaining yoke 80 firmly in position in contact with the bottle.

Figure 9:
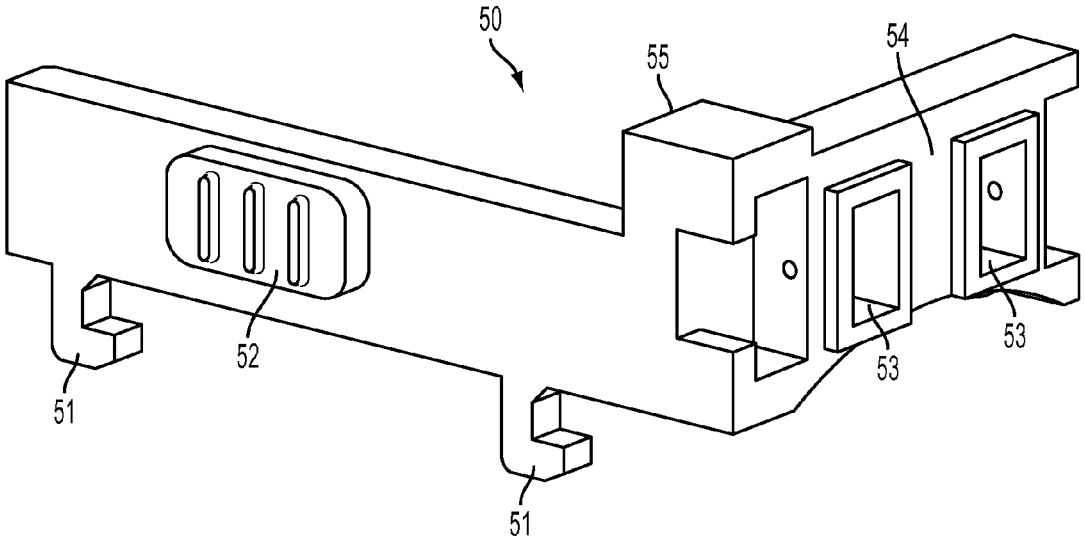
FIG. 9 is a perspective view of a latch of the embodiment of the anti-theft tag of FIG. 1.

FIG. 9 is a perspective view of latch 50 of the embodiment of anti-theft tag 10 of FIG. 1. Latch 50 can be seen in section in FIG. 6 as well as in FIGS. 3 and 4. Latch 50 has hooks 51, button 52, spring seats 53, pawl nest 54, and knee 55. Button 52 is exposed in latch button aperture 24 in housing 21 and provides a means for manually changing the position of latch 50. When first component 20 and second component 30 are moved to the closed position and latch 50 is moved to the latched position, hooks 51 engage the edges of latch receiver apertures 39 and maintain tag 10 in the closed position.

In FIG. 6, blocking pin 60 and spring 61 may be seen in position within dome 29 of housing 21 of first component 20. Spring 61 biases blocking pin 60 outward from dome 29 toward the interior of housing 21. When latch 50 is in the unlatched position, knee 55 on latch 50 keeps blocking pin 60 and spring 61 compressed in dome 29. When latch 50 is moved to the latched position, knee 55 is moved and blocking pin 60 extends from dome 29 and moves into position behind knee 55 on latch 50. Blocking pin 60 then prevents latch 50 from being moved to the unlatched position. Blocking pin 60 is at least partially comprised of magnetically attractable material. To move latch 50 to the unlatched position, a magnet is applied externally to dome 29. This withdraws blocking pin 60 back into dome 29 and allows latch 50 to be moved to the unlatched position, releasing first component 20 and second component 30 to be moved from the closed position. When in the latched position, latch 50 contacts a switch, changing its state.

Figure 10:
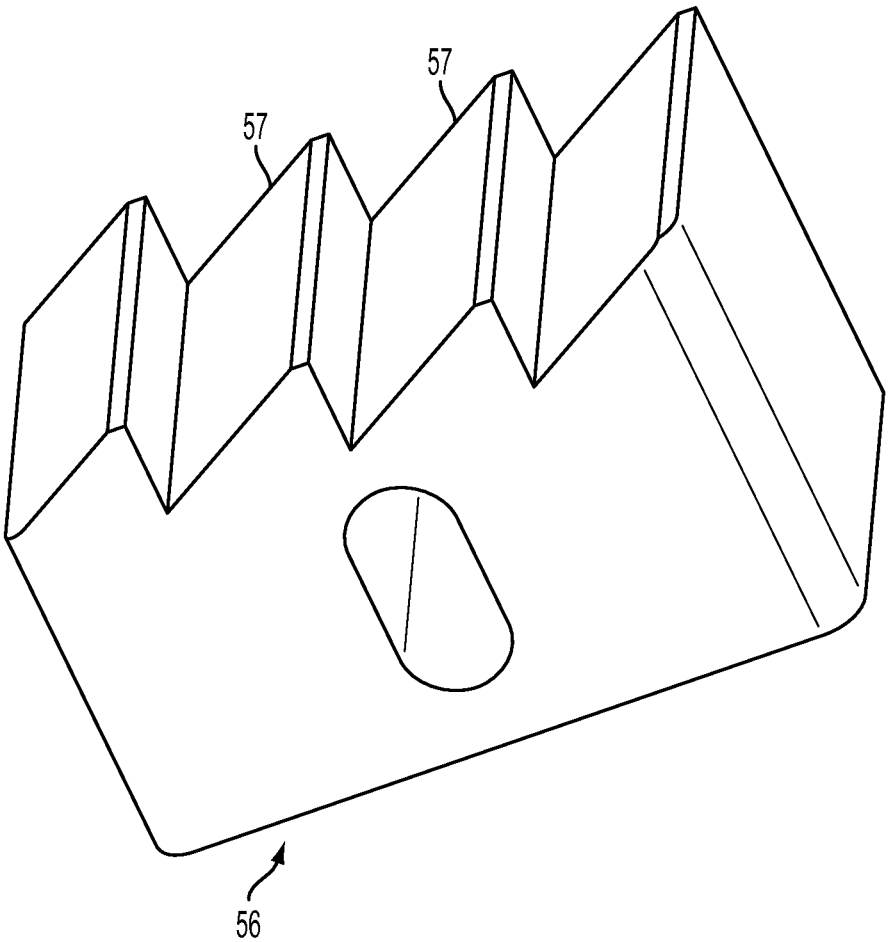
FIG. 10 is a perspective view of a pawl of the embodiment of the anti-theft tag of FIG. 1.

FIG. 10 is a perspective view of pawl 56 of the embodiment of anti-theft tag 10 of FIG. 1. Pawl 56 can be seen in position in FIG. 5. Pawl 56 has teeth 57 and is contained in pawl nest 54 on latch 50. Springs located in spring seats 53 in latch 50 bias pawl 56 away from latch 50. Referring to FIG. 5, teeth 57 on pawl 56 engage linear ratchet 84 on sliding yoke 80 when latch 50 is moved to the latched position. This locks sliding yoke 80 into the position that it is in when latch 50 is moved to the latched position. How far yoke 80 is pushed into housing 21 when latch 50 is moved to the latched position will determine where teeth 57 engage ratchet 84. With yoke 80 locked into position, a bottle cannot be easily removed from the passageway within closed tag 10.

Figure 11:
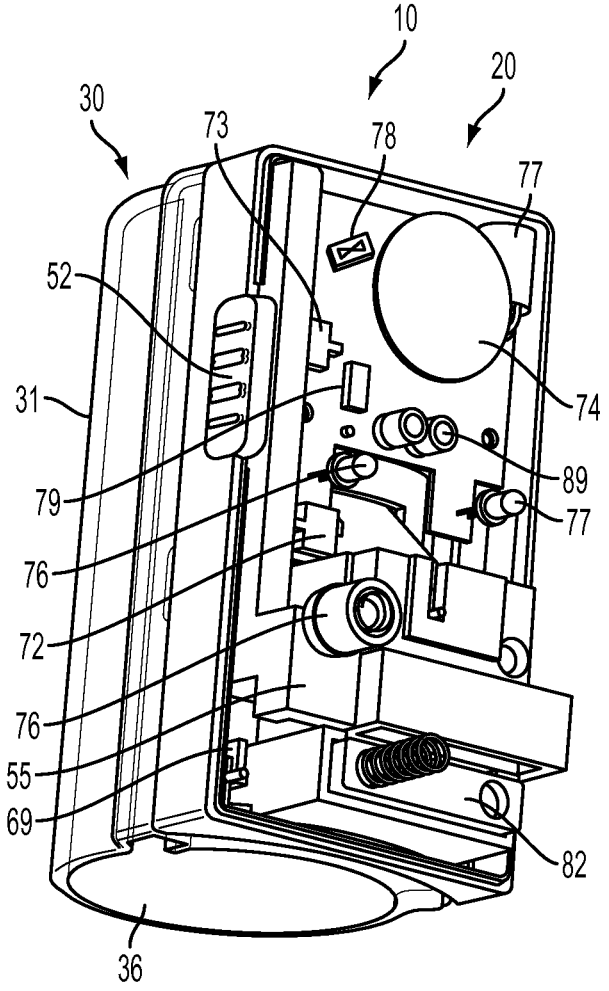
FIG. 11 is a rear perspective view of the embodiment of the anti-theft tag of FIG. 1 with the cover removed to show electronics contained therein.

FIG. 11 is a rear perspective view of the embodiment of anti-theft tag 10 of FIG. 1 with the cover removed to show electronics contained therein. Additional electronics can be seen in the sectional view of FIG. 5. Circuit board 70 provides the structure for mounting electronic elements as well as completing electrical circuits. In FIG. 11, lever switch 72, latch switch 73, audible alarm generator 74, infrared communication port 75, light emitting diode 76, battery 77, radio frequency communication circuitry 78 to interact in RFID systems, motion detection chip 79, magnetometer 89, and yoke switch 69 can be seen. In FIG. 5, microprocessor 71 is visible. Some embodiments of tag 10 may enclose a passive EAS element.

When tag 10 is closed around a bottle, the bottle moves lever 65 which changes the state of lever switch 72 and yoke 80 is moved which changes the state of yoke switch 69. When latch 50 is moved to the latched position, latch 50 changes the state of latch switch 73. In some embodiments of tag 10, the combined states of these switches will be enough for the electronics to arm. In other embodiments, communication from an external device may finalize the arming of the electronics.

Communication between anti-theft tag 10 and the external device may be by optical, infrared communication via infrared communication port 75, other wireless communication such as with radio frequency circuitry 78, or other known methods of communication. Once anti-theft tag 10 is armed, if it is removed from the protected bottle without prior disarming communication, the electronics of anti-theft tag 10 will determine an alarm condition and issue an alarm. The alarm may be an audible alarm generated by audible alarm generator 74. The alarm may also be a broadcast alarm broadcast by the communication elements of the electronics of tag 10 to respective receivers in other components of the broader electronic article surveillance system. The broadcast alarm may be broadcast by wireless communications such as infrared communication and radio frequency communication, or other type of communication. Receivers in the broader electronic article surveillance system such as those in base stations, hand held devices, etc. receive the broadcast alarm and can communicate to personnel with screen displays, audible alarms, etc. that an alarm condition has been determined in a tag and to take appropriate action.

Returning to FIGS. 2 and 3 where hoop 35 is well shown, hoop 35 creates bottle aperture 36. A bottle must be inserted through bottle aperture 36 in order for tag 10 to be closed around the bottle. Once tag 10 is closed and latch 50 is moved to the latched position, if first component 20 and second component 30 are forcibly rotated out of the closed position without disarming tag 10, hoop 35 will pull the bottle away from first component 20 releasing lever 65 and yoke 80. The release of lever 65 and yoke 80 will change the state of their associated switches which the electronics will interpret as an alarm condition and the electronics will alarm.

In FIG. 4 sound apertures 27 are visible and in FIG. 11 audible alarm generator 74 is visible. Sound apertures 27 provide direct access of the audible alarm to outside of housing 21. In FIG. 4 optical apertures 28 are also visible. Optical apertures 28 provide visibility to infrared communication port 75 and light emitting diode 76. Infrared communication port 75 provides a route to communicate with EAS tag 10 via infrared communication methods. Light emitting diode 76 provides visual cues for the status of EAS tag 10 and can transmit infrared as well.

Circuit board 70 and microprocessor 71 are capable of storing machine readable instructions and are programmable to monitor the status of EAS tag 10 and to communicate with remote programmers and other elements of an EAS system. Circuit board 70 and microprocessor 71 may be reprogrammed via communication with hand held remotes, or other elements of an EAS system when communicating with these devices. In the embodiment shown in FIGS. 1, 4, and 11 specifically, EAS tag 10 can communicate via infrared communication port 75 and LED 76 and also receive programming instructions. EAS tag 10 can also communicate via radio frequency circuitry 78 shown in FIG. 11 to interact in RFID systems.

Audible alarm generator 74 is capable of generating an audible alarm when EAS tag 10 is tampered with, for example, in an attempted unauthorized removal of EAS tag 10, bottle 500 may lose contact with lever 65 and yoke 80, changing the states of their associated switches, lever switch 72 and yoke switch 69, respectively. The change in status of arming either switch is detected by circuit board 70 and microprocessor 71 which can determine an alarm status for EAS tag 10 and generate an alarm signal. Audible alarm generator 74 may also be used to indicate the status of EAS tag 10 as it is installed. For example, when first component 20 and second component 30 are rotated to the closed position with bottle 500 in position, bottle 500 contacts lever 65 and yoke 80, which changes the state of the associated switches. When latch 50 is moved to the closed position, the state of latch switch 73 is changed. Audible alarm generator 74 can produce a sound indicating that EAS tag 10 is installed. If the electronics of tag 10 are so programmed that those conditions are sufficient to arm tag 10, the sound indicates that tag 10 is installed and armed. If the electronics are so programmed that communication from an external device is to finally arm tag 10, the sound indicates that tag 10 is ready to be armed by another device such as a handheld remote. Similarly, LED 76 can be used to provide visual cues for the status of EAS tag 10. Battery 77 generally provides power for the electronic components of EAS tag 10, such as audible alarm generator 74, microprocessor 71, LED 76, etc.

Some embodiments of EAS tag 10 may have an motion detection chip 79 in its electronic package. Motion detection chip 79 detects when the object being protected, bottle 500, is being moved. When motion detection chip 79 detects motion, it signals microprocessor 71 which may be programmed to take specific actions. These actions may include sending query signals out to the broader EAS system, checking for specific field signals from the broader EAS system, as well as other actions. Depending on what it determines upon receiving the signal from motion detection chip 79, microprocessor 71 may determine an alarm condition and generate an alarm.

EAS tag 10 may also carry a passive element compatible with prior art EAS systems. These EAS systems generate what is called an interrogation field at a given frequency. These interrogation fields will build up a small amount of stored energy on passive EAS elements brought into the zone. When the interrogation field is turned off and the EAS system listens for a response, the passive EAS elements dissipate their energy and generate a signal at a designed frequency. The EAS system is capable of detecting the signal as an indication of the unauthorized presence of the passive elements and can generate an alarm based on the signal. In some embodiments, circuit board 70 and microprocessor 71 can monitor the status of the passive element and issue an alarm as well. If microprocessor 71 or circuit board 70 detect energy storage and dissipation activity in the passive element, then audible alarm generator 74 may be instructed to generate an alarm or the communication capabilities of the electronics may be employed to broadcast a signal to respective receivers in the broader EAS system to generate an alarm. Any passive element known in the art could be used.

The electronics of some embodiments of EAS tag 10 may have passcode protection. These embodiments are capable of storing a passcode which is required to be matched by remote devices and detachers for various communications to be verified as authorized. For further protection the electronics of some embodiments of EAS tag 10 may include a clock generator and the electronics may have machine readable instructions with an algorithm to change the passcode at preprogrammed time intervals. The EAS system, including handheld remotes, also has at least one clock generator and is capable of updating the passcode at the preset intervals to update the system's record of the passcode. This keeps the passcode between EAS tag 10 and the rest of the EAS system synchronized.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. An anti-theft tag for a bottle having a neck and an annular feature about the neck proximal to the end of the bottle, said anti-theft tag comprising:

a first component hingably connected to a second component, said first and second components rotatable between open and closed positions and, when in said closed position, defining a passageway for enclosing the neck of a bottle to be protected;

said first component comprising a first latching component, a housing defining an internal compartment with a first aperture in said passageway passing from said internal compartment to external of said housing, and a lever pivotally mounted in said compartment and extending through said first aperture into said passageway;

electronics located within said internal compartment, said electronics comprising a first switch operatively associated with said lever, said first switch having two states, an open state and a closed state;

said second component comprising a second latching component;

said neck of said bottle contacting said lever and moving said lever sufficiently to change the state of said first switch when said first component and said second component are rotated to said closed position about said neck of said bottle, said first and second latching components combining to maintain said first and second components in said closed position when said latching components are engaged.

2. The anti-theft tag of claim 1, wherein:

said latching components are releasably lockable in engagement.

3. The anti-theft tag of claim 2, wherein:

said releasably lockable latching components may be unlocked by application of a magnet.

4. The anti-theft tag of claim 1, wherein:

said first latching component is a manually operated sliding latch movable between an engaged position and a disengaged position;

said anti-theft tag further comprising a biased blocking component, said biased blocking component moving to a blocking position when said sliding latch is manually slid to said engaged position, thereby blocking the return of said sliding latch;

said biased blocking component being movable to a non-blocking position by application of a magnet to a magnetically attractable element associated with said biased blocking component, the moving of said biased blocking component to a non-blocking position allowing said sliding latch to be manually moved to said disengaged position.

5. The anti-theft tag of claim 1, wherein:

said electronics further comprise a circuit board, a microprocessor, communication elements, an audible alarm generator, and a battery.

6. The anti-theft tag of claim 5, wherein:

if said electronics detect a change in the status of said first switch without authorizing communication being received by said communication elements in said electronics, said electronics determine an alarm condition and generate an alarm.

7. The anti-theft tag of claim 4, wherein;

said electronics further comprise a latch switch having two states, an open state and a closed state;

said latch changing the state of said latch switch and arming said tag when said first and second components are in said closed position and said latch is moved to said engaged position.

8. The anti-theft tag of claim 5, wherein;

said communication elements are capable of communicating with external devices to receive signals changing said anti-theft tag between armed and disarmed states.

9. The anti-theft tag of claim 6, wherein;

said alarm is an audible alarm.

10. The anti-theft tag of claim 6, wherein;

said alarm is an alarm signal broadcast by said communication elements for receipt by devices external to said anti-theft tag.

11. The anti-theft tag of claim 5, further comprising:

machine readable instructions encoded in said microprocessor for storing a passcode.

12. The anti-theft tag of claim 11, wherein:

said electronics further comprise an accurate clock generator, and said machine readable instructions further comprise an algorithm for generating multiple passcodes, wherein at specific time intervals said algorithm generates a new passcode and a previously stored passcode is replaced by said new passcode.

13. The anti-theft tag of claim 1, further comprising;

a passive electronic article surveillance element.

14. The anti-theft tag of claim 1, further comprising;

a panel on a first end of said second component, said panel extending over one end of said passageway when said first component and said second component are in said closed position, and, a hoop on a second end of said second component opposite to said first end of said second component, said hoop being oriented parallel to said panel, wherein when said tag is attached to a bottle, said bottle inserts through said hoop into said passageway and said panel encloses the end of said bottle.

15. The anti-theft tag of claim 1, further comprising;

a second aperture in said passageway passing from said internal compartment to external of said housing; and a yoke slidably mounted in said internal compartment and biased to extend through said second aperture into said passageway; wherein, when said first component and said second component are rotated to said closed position about the neck of the bottle said yoke impinges upon the neck of said bottle.

16. The anti-theft tag of claim 15, further comprising;

a second switch, said second switch operably associated with said yoke and having two states, an open state and a closed state; wherein, when said first component and said second component are rotated to said closed position about the neck of the bottle and said yoke impinges upon the neck of said bottle, said yoke changes the state of said second switch.

17. The anti-theft tag of claim 15, wherein;

when said first component and said second component are rotated to said closed position about the neck of the bottle and said latching components are engaged, said first latching component locks said yoke into place against the bottle.

18. An anti-theft tag for a bottle having a neck and an annular feature about the neck proximal to the end of the bottle, said anti-theft tag comprising:

a first component hingably connected to a second component, said first and second components rotatable between open and closed positions and, when in said closed position, defining a passageway for enclosing the neck of a bottle to be protected;

said first component comprising a first latching component, a housing defining an internal compartment with a first aperture in said passageway passing from said internal compartment to external of said housing, and a yoke slidably mounted in said internal compartment and biased to extend through said first aperture into said passageway;

electronics located within said internal compartment, said electronics comprising a first switch operatively associated with said yoke, said first switch having two states, an open state and a closed state;

said second component comprising a second latching component;

said neck of said bottle contacting said yoke and moving said yoke sufficiently to change the state of said first switch when said first component and said second component are rotated to said closed position about said neck of said bottle, said first and second latching components combining to maintain said first and second components in said closed position when said latching components are engaged.

19. The anti-theft tag of claim 18, further comprising;

a second aperture in said passageway passing from said internal compartment to external of said housing; and a lever pivotally mounted in said compartment and extending through said first aperture into said passageway; and, a second switch having two states, an open state and a second state, said second switch operably associated with said lever;

wherein, when said first component and said second component are rotated to said closed position about the neck of the bottle the bottle moves said lever sufficiently to change the state of said second switch.

20. The anti-theft tag of claim 18, wherein;

when said first component and said second component are rotated to said closed position about the neck of the bottle and said latching components are engaged, said first latching component locks said yoke into place against the bottle.

* * * * *